US009961449B2

(12) United States Patent
Honda et al.

(10) Patent No.: US 9,961,449 B2
(45) Date of Patent: May 1, 2018

(54) LOUDSPEAKER AND MOBILE BODY DEVICE HAVING LOUDSPEAKER MOUNTED THEREON

(71) Applicant: Panasonic Intellectual Property Management Co., Ltd., Osaka (JP)

(72) Inventors: Kazuki Honda, Osaka (JP); Mitsukazu Kuze, Osaka (JP); Motoyoshi Kitagawa, Gifu (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days. days.

(21) Appl. No.: 15/514,065

(22) PCT Filed: Oct. 2, 2015

(86) PCT No.: PCT/JP2015/005031
§ 371 (c)(1),
(2) Date: Mar. 24, 2017

(87) PCT Pub. No.: WO2016/059764
PCT Pub. Date: Apr. 21, 2016

(65) Prior Publication Data

US 2017/0303046 A1 Oct. 19, 2017

(30) Foreign Application Priority Data

Oct. 15, 2014 (JP) ..... 2014-210925

(51) Int. Cl.
*H04R 9/06* (2006.01)
*H04R 1/02* (2006.01)
(Continued)

(52) U.S. Cl.
CPC ..... *H04R 9/06* (2013.01); *H04R 1/025* (2013.01); *H04R 7/06* (2013.01); *H04R 7/18* (2013.01);
(Continued)

(58) Field of Classification Search
CPC ..... H04R 9/06; H04R 9/025; H04R 2499/13; H04R 7/04; H04R 7/06; H04R 7/10;
(Continued)

(56) References Cited

U.S. PATENT DOCUMENTS 4,379,951 A * 4/1983 Gabr ..... H04N 5/642 181/161
4,953,219 A * 8/1990 Kasai ..... H04S 1/002 381/63
(Continued)

FOREIGN PATENT DOCUMENTS

JP 56-056095 5/1981
JP 59-101595 U 7/1984
(Continued)

OTHER PUBLICATIONS

The Extended European Search Report dated Oct. 2, 2017 for the related European Patent Application No. 15851482.8.
(Continued)

*Primary Examiner* — Jason R Kurr
(74) *Attorney, Agent, or Firm* — Greenblum & Bernstein, P.L.C.

(57) ABSTRACT

A loudspeaker includes a frame, a diaphragm, an edge connecting portion, a magnetic circuit having a magnetic gap, and a voice coil body. The edge connecting portion connects an outer peripheral end portion of the diaphragm and the frame to each other. The diaphragm is disposed inside of the frame. The diaphragm has a planer diaphragm and a reinforcing diaphragm. Both a front surface and a rear
(Continued)

surface of the planer diaphragm are flat. The reinforcing diaphragm includes a thick portion and a recessed portion, and is joined to the planer diaphragm. The reinforcing diaphragm is made of resin. The thick portion is formed on an outer periphery of the reinforcing diaphragm. The recessed portion is formed at a center side of the reinforcing diaphragm.

8 Claims, 8 Drawing Sheets

(51) Int. Cl.
*H04R 7/06* (2006.01)
*H04R 7/18* (2006.01)
*H04R 9/02* (2006.01)

(52) U.S. Cl.
CPC ..... *H04R 9/025* (2013.01); *H04R 2400/11* (2013.01); *H04R 2499/13* (2013.01)

(58) Field of Classification Search
CPC ..... H04R 7/18; H04R 1/025; H04R 2400/11; H04R 2400/07
See application file for complete search history.

(56) References Cited

U.S. PATENT DOCUMENTS

| | | | | |
|---|---|---|---|---|
| 6,411,723 | B1 | 6/2002 | Lock et al. | |
| 6,490,363 | B1 * | 12/2002 | Liu | H04R 9/06 381/398 |
| 2004/0188175 | A1 * | 9/2004 | Sahyoun | H04R 7/122 181/157 |
| 2005/0201588 | A1 * | 9/2005 | Funahashi | H04R 7/26 381/423 |
| 2016/0057543 | A1 * | 2/2016 | Salvatti | H04R 9/043 381/398 |

FOREIGN PATENT DOCUMENTS

| | | |
|---|---|---|
| JP | 60-144393 U | 9/1985 |
| JP | 60-185498 | 9/1985 |
| JP | 60-200700 | 10/1985 |
| JP | 61-024399 | 2/1986 |
| JP | 62-115995 A | 5/1987 |
| JP | 2003-522429 | 7/2003 |
| JP | 2009-206914 | 9/2009 |
| JP | 2011-035812 | 2/2011 |

OTHER PUBLICATIONS

International Search Report of PCT application No. PCT/JP2015/005031 dated Dec. 22, 2015.

* cited by examiner

LOUDSPEAKER AND MOBILE BODY DEVICE HAVING LOUDSPEAKER MOUNTED THEREON

This application is a U.S. national stage application of the PCT International Application No. PCT/JP2015/005031 filed on Oct. 2, 2015, which claims the benefit of foreign priority of Japanese patent application 2014-210925 filed on Oct. 15, 2014, the contents all of which are incorporated herein by reference.

TECHNICAL FIELD

This disclosure relates to a loudspeaker which uses a planer diaphragm used in acoustic equipment, and a mobile body device having the loudspeaker mounted thereon.

BACKGROUND

Loudspeakers are required to have various configurations depending on usage. For example, a vehicle-mounted loudspeaker installed in a dashboard of a vehicle, a ceiling of a vehicle or the like is required to be particularly as thin as possible.

To decrease the thickness of a loudspeaker, in general, it is necessary to decrease the thickness of a diaphragm, to shorten a bobbin on which a voice coil is wound in a winding axis direction of the voice coil, or to decrease the thickness of a magnetic circuit. On the other hand, it is difficult for a loudspeaker having a thin thickness to ensure the rigidity of a diaphragm or to ensure a sound pressure level of a sound outputted from the loudspeaker.

As citation list information relating to the invention of the present application, for example, Unexamined Japanese Patent Publication No. 56-56095 and Unexamined Japanese Patent Publication No. 2011-35812 have been known.

SUMMARY

A loudspeaker according to this disclosure includes a frame, a diaphragm, an edge connecting portion, a magnetic circuit having a magnetic gap, and a voice coil body. The edge connecting portion connects an outer peripheral end portion of the diaphragm and the frame to each other. A first end portion of the voice coil body is disposed inside of the magnetic gap. On the other hand, a second end portion of the voice coil body is joined to a center portion of the diaphragm.

The diaphragm is disposed inside of the frame. The diaphragm has a planer diaphragm and a reinforcing diaphragm. Both a front surface and a rear surface of the planer diaphragm are flat. The reinforcing diaphragm includes a thick portion and a recessed portion, and is joined to the planer diaphragm. The reinforcing diaphragm is made of a resin. The thick portion is formed on an outer periphery of the reinforcing diaphragm. The recessed portion is formed at a center side of the reinforcing diaphragm.

The magnetic circuit is fixed to the frame. The magnetic circuit is disposed at a position which opposedly faces the recessed portion.

As described above, in the loudspeaker of this disclosure, the recessed portion is formed at the center portion of the diaphragm. The magnetic circuit is disposed at the position which opposedly faces the recessed portion. Accordingly, the loudspeaker can be made thin. Further, the diaphragm has the reinforcing diaphragm having the thick portion, and therefore the diaphragm has high rigidity. On the other hand, the recessed portion is formed at the center side of the reinforcing diaphragm, and therefore the weight of the diaphragm can be reduced, so that the sound pressure level of the diaphragm can be increased.

DESCRIPTION OF EMBODIMENT

A planar diaphragm of a conventional loudspeaker has a low strength. Accordingly, the diaphragm has a problem that it is necessary to increase the thickness of the planar diaphragm and thus the thickness of the loudspeaker cannot be decreased.

This disclosure has been made to overcome such a problem, and provides a thin loudspeaker having a favorable sound pressure level and little sound distortion.

Hereinafter, an exemplary embodiment of this disclosure is described.

Exemplary Embodiment

Figure 1:
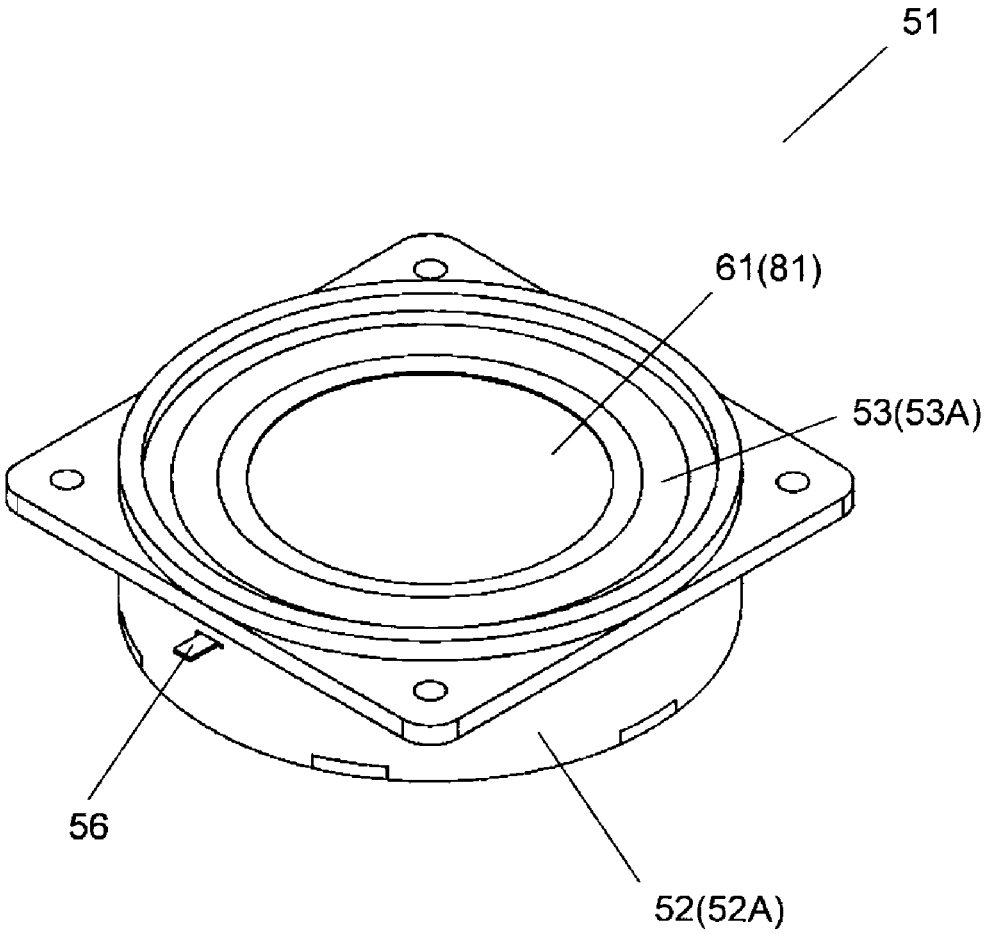
FIG. 1 is a perspective view of a loudspeaker according to an exemplary embodiment.
Figure 2:
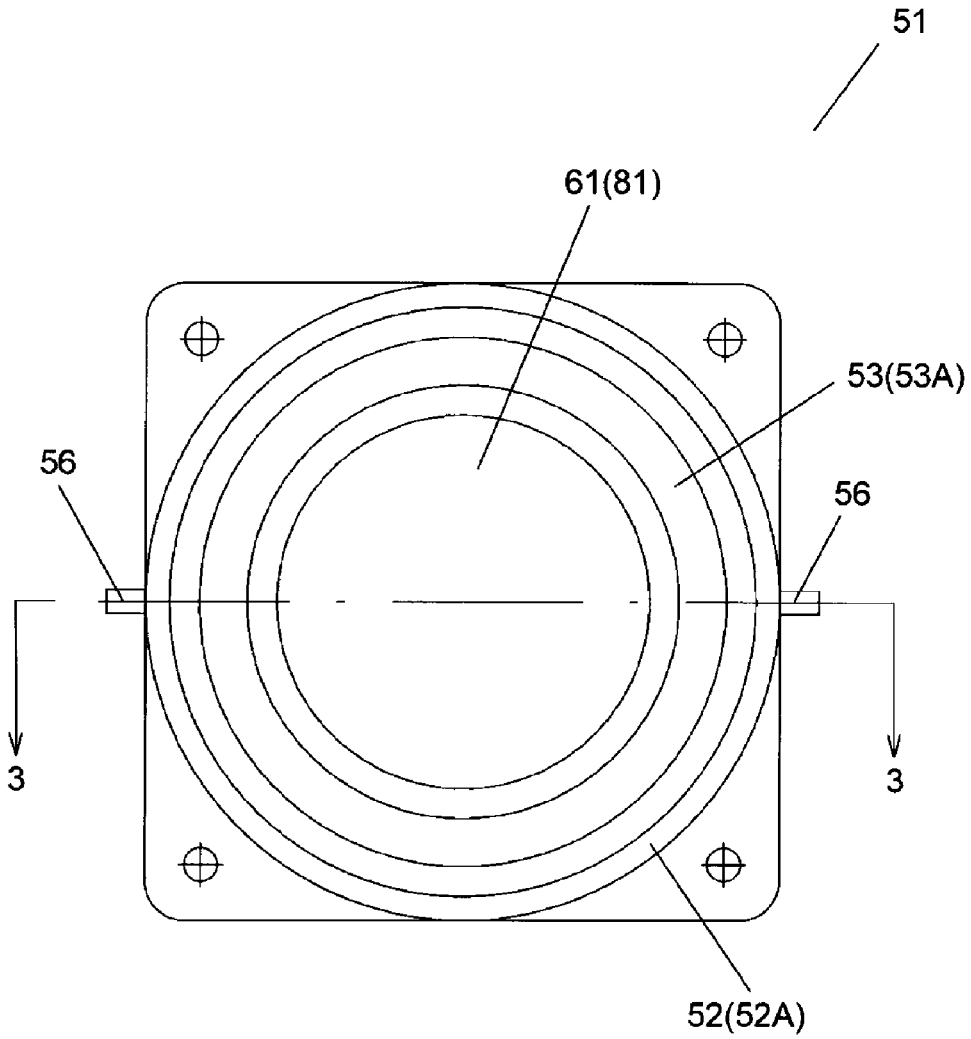
FIG. 2 is a plan view of the loudspeaker according to the exemplary embodiment.
Figure 3:
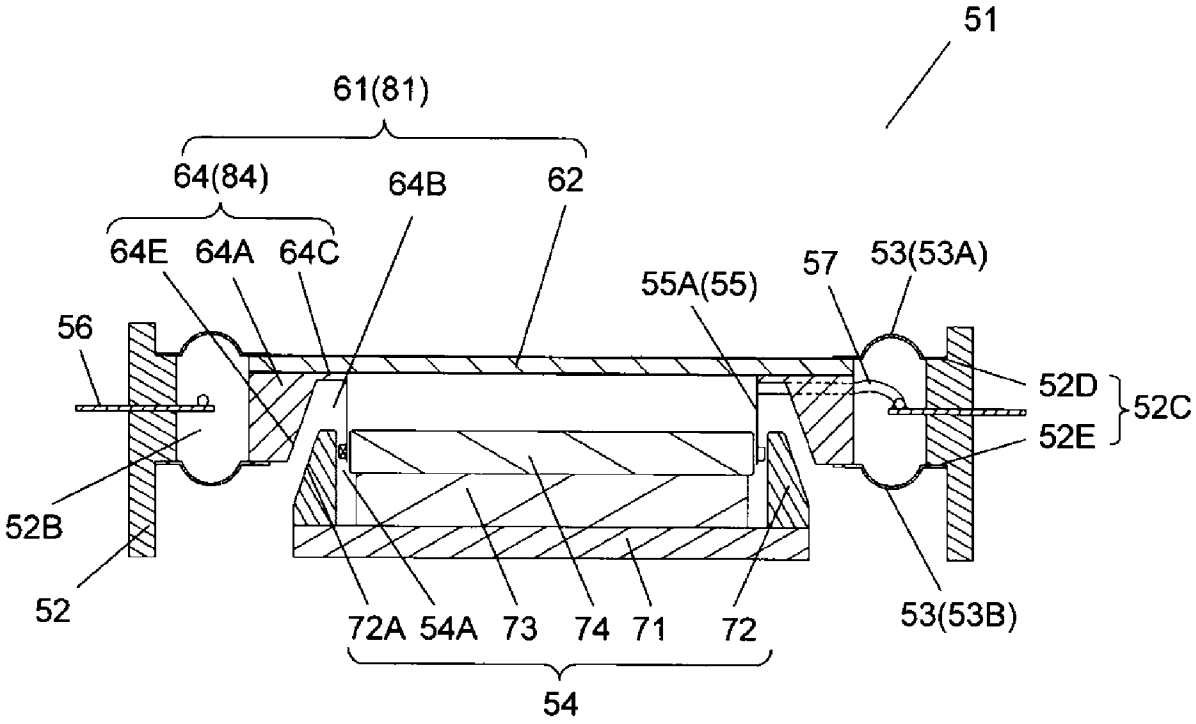
FIG. 3 is a cross-sectional view of the loudspeaker according to the exemplary embodiment.

The loudspeaker is required to have various configurations depending on usage. For example, a vehicle-mounted loudspeaker is installed in a narrow space such as a dashboard, a door, or a ceiling of a vehicle. Accordingly, the vehicle-mounted loudspeaker installed in such a place is required to be thin. Hereinafter, thin loudspeaker 51 according to the exemplary embodiment is described with reference to FIG. 1 to FIG. 6. FIG. 1 is a perspective view of loudspeaker 51. FIG. 2 is a plan view of loudspeaker 51. FIG. 3 is a cross-sectional view of loudspeaker 51 taken along a line 3-3 in FIG. 2.

As shown in FIG. 3, loudspeaker 51 includes: frame 52; edge connecting portion 53; magnetic circuit 54 having magnetic gap 54A; voice coil body 55; and diaphragm 61. Edge connecting portion 53 connects an outer peripheral end portion of diaphragm 61 and frame 52 to each other. A first end portion of voice coil body 55 is disposed inside of magnetic gap 54A. On the other hand, a second end portion of voice coil body 55 is connected to a center portion of diaphragm 61. Magnetic circuit 54 is fixed to frame 52. Diaphragm 61 is disposed inside of frame 52. In this exemplary embodiment, for example, the magnetic circuit is formed of a magnet and a magnetic body surrounding the magnet, and the flow of a magnetic flux from the magnet forms a circuit. A magnetic gap is configured by a spatial gap formed in such a circuit. Accordingly, in the magnetic gap, a magnetic flux exists in the spatial gap. In this disclosure, magnetic circuit 54 is formed of, for example, a bottom plate 71, yoke 72, magnet 73, and top plate 74. A spatial gap formed between an inner surface of yoke 72 and an outer peripheral side surface of top plate 74 serves as magnetic gap 54A.

Figure 5:
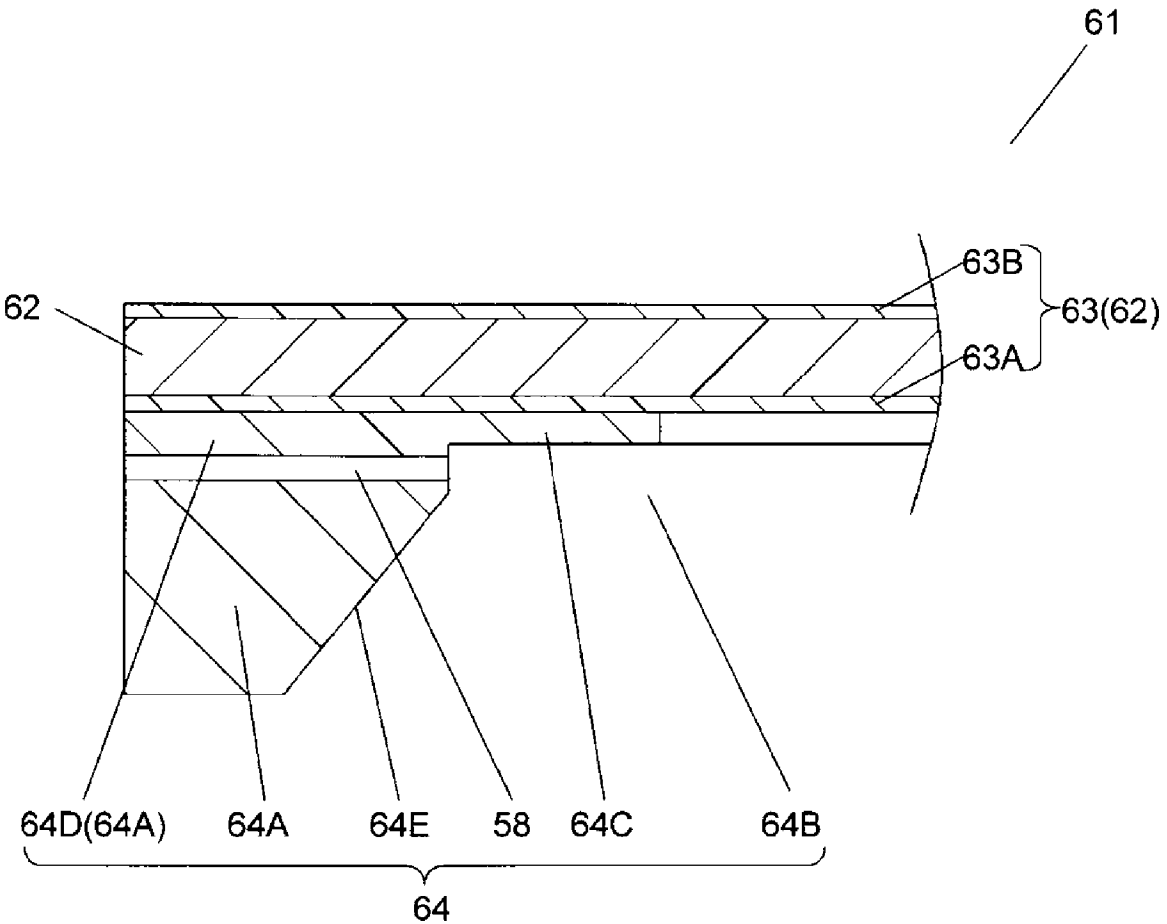
FIG. 5 is an enlarged cross-sectional view of a main part of a diaphragm according to the exemplary embodiment.

FIG. 5 is an enlarged cross-sectional view of a main part of diaphragm 61. Diaphragm 61 includes planar diaphragm 62, reinforcing material layers 63, and reinforcing diaphragm 64. Both a front surface and a rear surface of planar diaphragm 62 are flat. Reinforcing material layer 63 is formed on the front surface of planar diaphragm 62 and the rear surface of planar diaphragm 62. Reinforcing diaphragm 64 is joined to planar diaphragm 62 via reinforcing material layer 63.

Reinforcing diaphragm 64 includes thick portion 64A and recessed portion 64B. Thick portion 64A is formed on the outer periphery of reinforcing diaphragm 64. Recessed portion 64B is formed at a center side of reinforcing diaphragm 64 with respect to thick portion 64A. Reinforcing diaphragm 64 is disposed on a rear surface side of planar diaphragm 62 and hence, recessed portion 64B is formed in a region including the center of a back surface of diaphragm 61. It is preferable that reinforcing diaphragm 64 is made of a resin.

As shown in FIG. 3, magnetic circuit 54 is disposed at a position which opposedly faces recessed portion 64B. With such a configuration, magnetic circuit 54 and diaphragm 61 can be disposed close to each other and hence, a distance between an upper surface of magnetic circuit 54 and a front surface of diaphragm 61 can be decreased. Accordingly, the thickness of loudspeaker 51 can be made thin. Recessed portion 64B is formed in a region including the center of diaphragm 61, and thick portion 64A is formed on the outer peripheral portion of diaphragm 61. Accordingly, even when the thickness of the center portion of diaphragm 61 is thin, the mechanical strength of diaphragm 61 can be increased. As a result, diaphragm 61 can be light-weighted, so that the sound pressure level of diaphragm 61 can be raised.

Next, loudspeaker 51 is described in more detail. As shown in FIG. 1, frame 52 has body part 52A. Body part 52A has a hollow cylindrical shape. When diaphragm 61 has a circular shape as viewed from the front surface, it is preferable that body part 52A has a circular cylindrical shape.

As shown in FIG. 3, frame 52 has an outer side surface and an inner side surface. Mounting portion 52C is formed on the inner side surface of frame 52. Edge connecting portion 53 is joined to mounting portion 52C. In loudspeaker 51, gap 52B is formed between the side surface of an outer peripheral portion of diaphragm 61 and the inner side surface of frame 52.

Loudspeaker 51 may further include terminals 56. In this case, terminals 56 penetrate frame 52 from the inner side surface to the outer side surface. With such a configuration, one end of each terminal 56 is disposed inside of gap 52B. Further, it is preferable that loudspeaker 51 includes relay line 57. Relay line 57 electrically connects terminals 56 and voice coil 55A to each other.

It is preferable that relay line 57 penetrates reinforcing diaphragm 64 and is extracted from the side surface of the outer peripheral portion of diaphragm 64. Relay line 57 extracted from the side surface of the outer peripheral portion of reinforcing diaphragm 64 is wired toward terminal 56 inside gap 52B, and is electrically connected to terminal 56. With such a configuration, in loudspeaker 51, a space in which relay line 57 is disposed on a rear surface side of diaphragm 61 can be made small. Accordingly, loudspeaker 51 can be made thin. Further, it is more preferable that relay line 57 is extracted from an outer peripheral side surface of thick portion 64A. With such a configuration, loudspeaker 51 can be made thin.

The edge connecting portion 53 has a circular annular shape as viewed from the front surface as shown in FIG. 2. As shown in FIG. 3, it is preferable that edge connecting portion 53 has first edge connecting portion 53A and second edge connecting portion 53B. Both first edge connecting portion 53A and second edge connecting portion 53B connect the outer peripheral end portion of diaphragm 61 and frame 52 to each other. It is preferable that second edge connecting portion 53B is disposed on a side opposite to first edge connecting portion 53A with respect to the center of the outer peripheral side surface of diaphragm 61 in the thickness direction interposed therebetween. It is preferable that terminal 56 is disposed at a position between first edge connecting portion 53A and second edge connecting portion 53B in a thickness direction of diaphragm 61. Further, it is preferable that relay line 57 is extracted from the side surface of the outer peripheral portion of diaphragm 61. With such a configuration, loudspeaker 51 can be made thin.

Outer peripheral end portions of first edge connecting portion 53A and second edge connecting portion 53B are adhered to mounting portion 52C. Thus, mounting portion 52C projects from the inner peripheral surface of frame 52. Further, mounting portion 52C has first mounting surface 52D and second mounting surface 52E. First mounting surface 52D and second mounting surface 52E are formed to stand in a direction perpendicular to the inner side surface of frame 52. First edge connecting portion 53A is connected to first mounting surface 52D. On the other hand, second edge connecting portion 53B is connected to second mounting surface 52E.

It is preferable that an inner peripheral end portion of first edge connecting portion 53A is connected to a front surface of diaphragm 61, and an inner peripheral end portion of second edge connecting portion 53B is connected to a rear surface of thick portion 64A. With such a configuration, a distance between first edge connecting portion 53A and second edge connecting portion 53B can be increased. Accordingly, it is possible to prevent edge connecting portion 53 from being brought into contact with terminal 56. It is also possible to suppress the generation of rolling of diaphragm 61.

Figure 4:
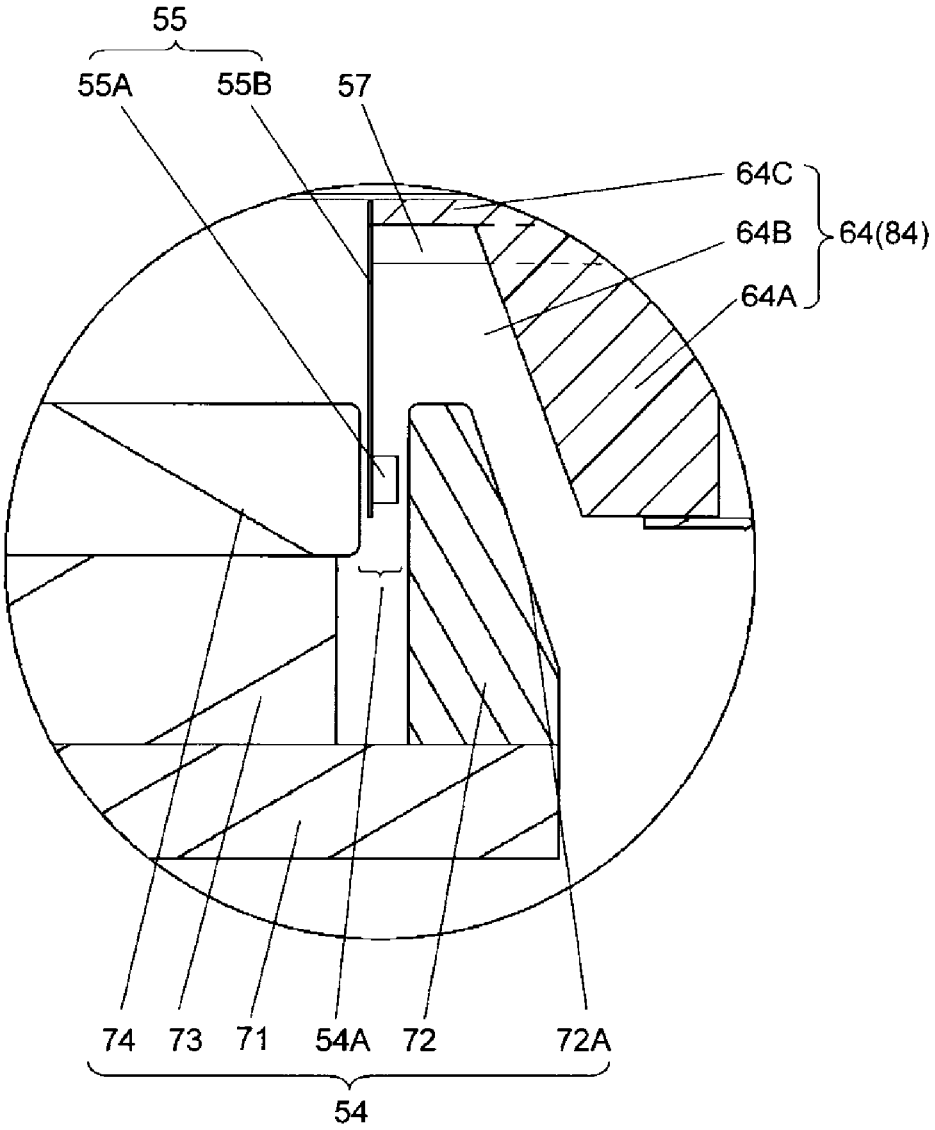
FIG. 4 is an enlarged cross-sectional view of a main part of a magnetic gap part of the loudspeaker according to the exemplary embodiment.

It is preferable that first edge connecting portion 53A and second edge connecting portion 53B are disposed symmetrically with each other with respect to a plane perpendicular to a winding shaft direction of voice coil 55A shown in FIG. 4. With such a configuration, a distortion characteristic of diaphragm 61 is improved. Loudspeaker 51 of the exemplary embodiment is not limited to the configuration which includes both first edge connecting portion 53A and second edge connecting portion 53B. Loudspeaker 51 may adopt a configuration which includes only either one of first edge connecting portion 53A or second edge connecting portion 53B.

FIG. 4 is an enlarged cross-sectional view of a main part of loudspeaker 51 in the vicinity of magnetic gap 54A. Voice coil body 55 has voice coil 55A. Voice coil 55A may have bobbin 55B. In this case, voice coil 55A is wound on bobbin 55B. Voice coil body 55 is not limited to the configuration which includes bobbin 55B. Voice coil body 55 may be formed of only voice coil 55A.

Magnetic circuit 54 is an internal-magnetic-type magnetic circuit, for example. It is preferable that magnetic circuit 54 includes bottom plate 71, yoke 72, magnet 73, and top plate 74. Magnet 73 is mounted on an upper surface of bottom plate 71, and is magnetically connected to bottom plate 71. Top plate 74 is mounted on an upper surface of magnet 73, and is magnetically connected to magnet 73. Yoke 72 is disposed on an outer periphery of bottom plate 71. Yoke 72 is standing from a lower surface toward an upper surface of magnetic circuit 54. An inner peripheral surface of yoke 72 is disposed so as to opposedly face a side surface of an outer peripheral side surface of top plate 74. Magnetic gap 54A is provided between an inner surface of yoke 72 and the outer peripheral side surface of top plate 74.

It is preferable that tapered portion 72A is formed on an outer peripheral side surface of yoke 72. In this case, it is preferable that inclined portion 64E is formed on the inner peripheral side surface of reinforcing diaphragm 64. Inclined portion 64E is disposed so as to opposedly face tapered portion 72A. With such a configuration, magnetic circuit 54 and diaphragm 61 can be disposed close to each other and hence, loudspeaker 51 can be made thin. Magnetic circuit 54 is not limited to an internal-magnetic-type magnetic circuit, and may be an external-magnetic-type magnetic circuit, or may be a combination of an internal-magnet-type magnetic circuit and an external-magnetic-type magnetic circuit.

Figure 6:
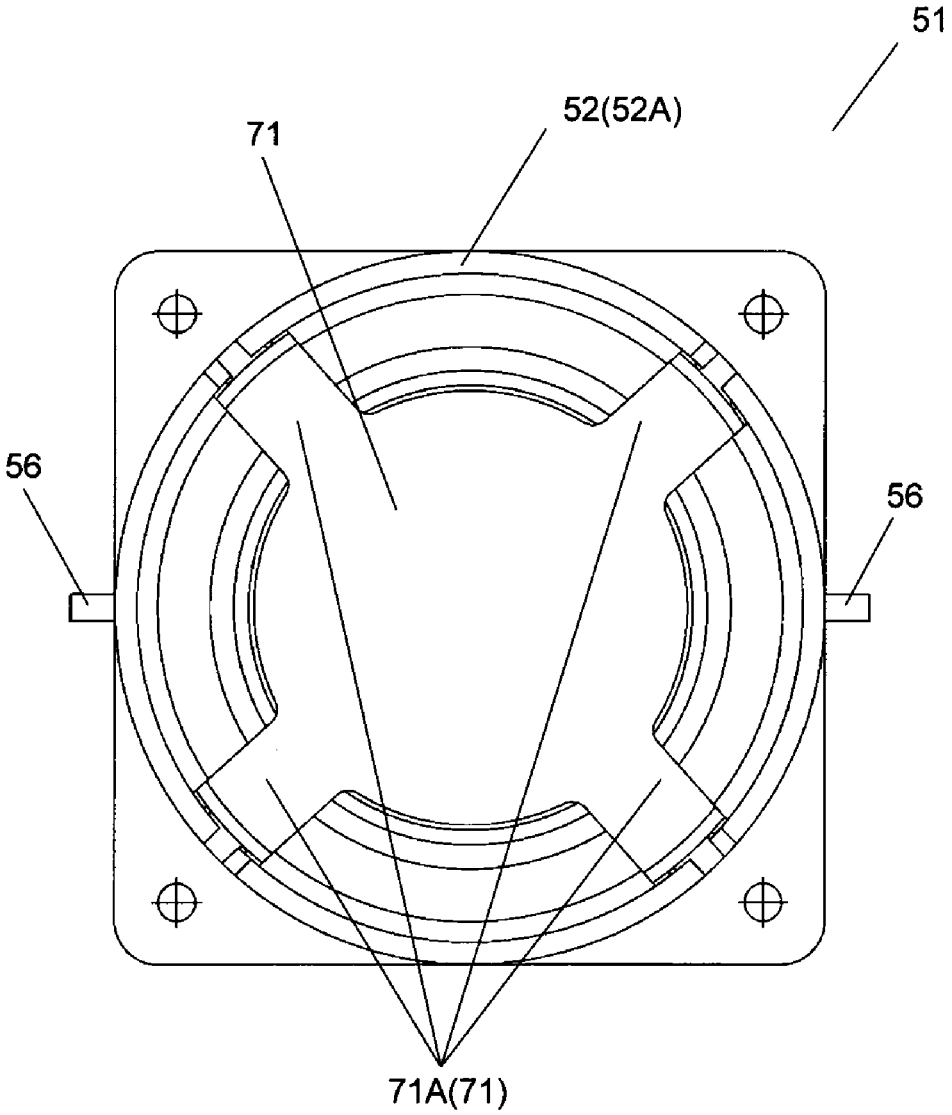
FIG. 6 is a back view of the loudspeaker according to the exemplary embodiment.

FIG. 6 is a back view of loudspeaker 51. It is preferable that bottom plate 71 includes connecting portions 71A. Connecting portions 71A extend in directions toward an outer peripheral from a portion of bottom plate 71 where magnet 73 is disposed. Distal end portions of connecting portions 71A are connected to frame 52. With such a configuration, magnetic circuit 54 is connected to frame 52 via connecting portions 71A.

Yoke 72 and bottom plate 71 may be formed integrally. That is, yoke 72 is formed in a bent shape from an outer peripheral end portion of bottom plate 71. In this case, it is preferable that connecting portion 71A is formed of a component different from a portion of bottom plate 71 where magnet 73 is disposed.

Further, it is preferable that connecting portion 71A is made of a non-magnetic material. With such a configuration, it is possible to suppress leakage of a magnetic flux of magnetic circuit 54 to connecting portion 71A. Further, it is preferable that connecting portion 71A is made of a material having high thermal conductivity. Connecting portion 71A may be made of aluminum or copper, for example. With such a configuration, heat generated by magnetic circuit 54 can be radiated through connecting portion 71A.

It is preferable that planar diaphragm 62 and reinforcing diaphragm 64 shown in FIG. 5 is made of a foam resin material. With such a configuration, diaphragm 61 can be light-weighted and hence, response characteristic of diaphragm 61 can be improved. Accordingly, a sound output from diaphragm 61 rises quickly. Further, a sound pressure level of a sound outputted from diaphragm 61 can be enhanced and hence, a limit in a high frequency region of reproduction sound by diaphragm 61 can be raised. It is preferable that planar diaphragm 62 and reinforcing diaphragm 64 are made of a hard foam resin material. With such a configuration, a sound speed and a sound pressure level of a sound outputted from diaphragm 61 can be increased. A material for forming planar diaphragm 62 is not limited to a foam resin, and planar diaphragm 62 may be a diaphragm having a honeycomb structure made of paper or metal. Alternatively, planar diaphragm 62 may be made of a non-foam resin.

It is preferable that planar diaphragm 62 includes reinforcing material layer 63. It is preferable that reinforcing material layer 63 has first reinforcing material layer 63A disposed on a rear surface of planar diaphragm 62. In this case, reinforcing diaphragm 64 is connected to first reinforcing material layer 63A. That is, on the outer peripheral portion of diaphragm 61, first reinforcing material layer 63A is sandwiched between reinforcing diaphragm 64 and planar diaphragm 62.

With such a configuration, planar diaphragm 62 has first reinforcing material layer 63A and hence, planar diaphragm 62 has high rigidity. Accordingly, the weight of planar diaphragm 62 can be decreased and hence, the sound pressure level of diaphragm 61 can be increased.

Further, first reinforcing material layer 63A is connected to the flat surface and hence, it is possible to suppress the occurrence of wrinkles on first reinforcing material layer 63A. Accordingly, it is possible to suppress the formation of a gap between first reinforcing material layer 63A and reinforcing diaphragm 64. As a result, it is possible to suppress the generation of undesired resonance of diaphragm 61 and hence, it is possible to suppress the generation of peaks or dips in a frequency characteristic of diaphragm 61. Further, it is possible to suppress that reinforcing diaphragm 64 is disposed in an inclined manner with respect to the rear surface of planar diaphragm 62. Accordingly, it is possible to suppress the generation of rolling of diaphragm 61. As a result, it is possible to prevent voice coil 55A shown in FIG. 4 from being brought into contact with magnetic circuit 54. Further, it is possible to reduce a distortion of a sound outputted from diaphragm 61 shown in FIG. 3.

Reinforcing material layer 63 may further include second reinforcing material layer 63B. Second reinforcing material layer 63B is formed on planar diaphragm 62 at a side opposite to first reinforcing material layer 63A. That is, second reinforcing material layer 63B is formed on a front surface of planar diaphragm 62. With such a configuration, the strength of diaphragm 61 can be further enhanced. It is preferable that reinforcing material layer 63 is made of a hard and light material. With such a configuration, a sound speed and a sound pressure level of a sound outputted from diaphragm 61 can be increased. Reinforcing material layer 63 can be made of carbon, metal or the like, for example. As a material for forming metal-made reinforcing material layer 63, aluminum or titanium can be used, for example.

Recessed portion 64B may include a hole that penetrates reinforcing diaphragm 64 (through hole). In this case, first reinforcing material layer 63A is exposed through the through hole formed in recessed portion 64B. Accordingly, it is preferable that reinforcing diaphragm 64 includes first insulating portion 64C on a bottom of recessed portion 64B. First insulating portion 64C is disposed between relay line 57 and first reinforcing material layer 63A. In this case, as shown in FIG. 3 and FIG. 4, voice coil body 55 is joined to first insulating portion 64C. With such a configuration, it is possible to suppress that first reinforcing material layer 63A and relay line 57 are electrically short-circuited to each other.

It is preferable that first insulating portion 64C is integrally formed with thick portion 64A using the same material as thick portion 64A. In this case, it is preferable that recessed portion 64B has a bottom formed of first insulating portion 64C. That is, first reinforcing material layer 63A is covered by first insulating portion 64C at the bottom of recessed portion 64B formed of first insulating portion 64C, and is not exposed. With such a configuration, even when relay line 57 is vibrated, it is possible to prevent the occurrence of electrical short-circuiting between relay line 57 and first reinforcing material layer 63A. Further, a process for additionally interposing first insulating portion 64C between relay line 57 and first reinforcing material layer 63A becomes unnecessary.

The exemplary embodiment is not limited to the configuration where first insulating portion 64C and thick portion 64A are formed integrally, and first insulating portion 64C and thick portion 64A may be formed as parts that are separated from each other. In this case, first insulating portion 64C may be formed of an insulating tape having both surfaces thereof coated with an adhesive agent or the like, for example. Alternatively, first insulating portion 64C may be formed of an insulating tube.

It is preferable that first insulating portion 64C has a uniform thickness. With such a configuration, it is possible to suppress the occurrence of a state where the center of gravity of diaphragm 61 is displaced from a winding shaft of voice coil 55A. Accordingly, a distortion of a sound outputted from diaphragm 61 can be reduced.

As shown in FIG. 5, it is preferable that thick portion 64A includes second insulating portion 64D. Thick portion 64A is formed on the outer periphery of reinforcing diaphragm 64 and hence, thick portion 64A has an annular shape. Accordingly, through hole 58 is formed so as to penetrate from an inner peripheral side surface of thick portion 64A, which forms the side surface of recessed portion 64B, to an outer peripheral side surface of thick portion 64A. Relay line 57 shown in FIG. 3 is inserted into through hole 58. With such a configuration, second insulating portion 64D is formed between through hole 58 formed in thick portion 64A and first reinforcing material layer 63A. Accordingly, it is possible to suppress that relay line 57 and first reinforcing material layer 63A are electrically short-circuited from each other.

The exemplary embodiment is not limited to the configuration where relay line 57 shown in FIG. 3 is inserted into through hole 58, and relay line 57 may be formed by insert molding at the time of forming reinforcing diaphragm 64. With such a configuration, a process for inserting relay line 57 shown in FIG. 3 into through hole 58 becomes unnecessary.

Figure 7:
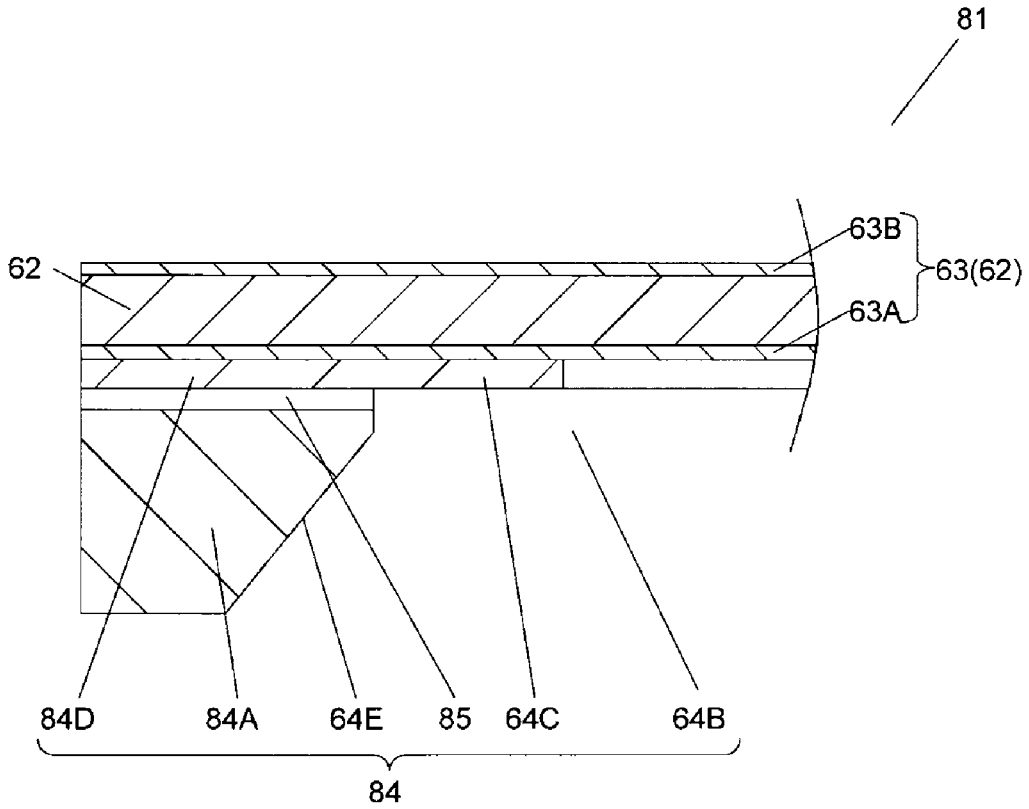
FIG. 7 is an enlarged cross-sectional view of a main part of a diaphragm according to a variation of the exemplary embodiment.

FIG. 7 is an enlarged cross-sectional view of a main part of diaphragm 81 according to a variation of the exemplary embodiment. Diaphragm 81 includes reinforcing diaphragm 84, in place of reinforcing diaphragm 64 of diaphragm 61. Reinforcing diaphragm 84 includes thick portion 84A and second insulating portion 84D. Second insulating portion 84D and thick portion 84A are formed as parts that are separated from each other. Second insulating portion 84D is disposed between first reinforcing material layer 63A and thick portion 84A.

Reinforcing diaphragm 84 may include first insulating portion 64C. In this case, first insulating portion 64C and second insulating portion 84D is formed integrally using the same material. It is preferable that the outer periphery of second insulating portion 84D has the same profile as that of planar diaphragm 62, and a diameter of the outer periphery of second insulating portion 84D is the same as a diameter of planar diaphragm 62.

Groove 85 is formed on a joint portion between second insulating portion 84D and thick portion 84A. Relay line 57 shown in FIG. 3 is wired along groove 85. Although groove 85 is formed on thick portion 84A, the variation of the exemplary embodiment is not limited to such a configuration. Groove 85 may be formed on only second insulating portion 84D or on both second insulating portion 84D and thick portion 84A. With such a configuration, by bonding second insulating portion 84D and thick portion 84A to each other in a state where relay line 57 shown in FIG. 3 is wired along groove 85, it is possible to provide the configuration where relay line 57 shown in FIG. 3 penetrates reinforcing diaphragm 84. Accordingly, a process for making relay line 57 pass through the through hole becomes unnecessary. At the time of applying an adhesive agent by coating to an adhesive area between second insulating portion 84D and thick portion 84A, it is preferable to apply the adhesive agent by coating also to groove 85 simultaneously. With such a configuration, a process for additionally applying an adhesive agent by coating to groove 85 becomes unnecessary. As a result, it is possible to reduce the number of man-hours for assembling diaphragm 81. Other configurations of this variation are substantially equal to the corresponding configurations of the exemplary embodiment.

Next, a method for assembling loudspeaker 51 is described with reference to FIG. 3. The method for assembling loudspeaker 51 includes the steps of preparing frame 52, preparing an assembly of magnetic circuit 54, preparing voice coil body 55, preparing an assembly of planar diaphragm 62, joining diaphragm 61 to frame 52, joining the assembly of magnetic circuit 54 to frame 52, and preparing an assembly of reinforcing diaphragm 64.

In the step of preparing frame 52, resin-made frame 52 is prepared by injection molding or the like. It is preferable that terminals 56 are formed by insert molding at the time of preparing frame 52.

In the step of preparing the assembly of magnetic circuit 54, magnet 73 and yoke 72 are joined to an upper portion of bottom plate 71 using an adhesive agent or the like. Top plate 74 is joined to an upper portion of magnet 73 using an adhesive agent or the like. Then, magnetic gap 54A having a predetermined size is formed between the outer peripheral side surface of top plate 74 and the inner peripheral side surface of yoke 72.

In the step of preparing voice coil body 55, voice coil 55A is prepared by winding a wire. When voice coil body 55 includes bobbin 55B, voice coil 55A is wired on the outer peripheral side surface of bobbin 55B.

The method for preparing the assembly of planar diaphragm 62 is described with reference to FIG. 5 and FIG. 3. In the step of preparing the assembly of planar diaphragm 62, first reinforcing material layer 63A is adhered to a rear surface of planar diaphragm 62. When the assembly of planar diaphragm 62 includes second reinforcing material layer 63B, second reinforcing material layer 63B is adhered to a front surface of planar diaphragm 62. Then, an inner peripheral portion of first edge connecting portion 53A is adhered to planar diaphragm 62 or second reinforcing material layer 63B.

In the step of preparing the assembly of reinforcing diaphragm 64 shown in FIG. 3, an inner peripheral portion of second edge connecting portion 53B is adhered to thick portion 64A. First reinforcing material layer 63A shown in FIG. 5 is adhered in the step of preparing the assembly of planar diaphragm 62. However, the method for assembling loudspeaker 51 is not limited to such a procedure, and first reinforcing material layer 63A may be adhered in the step of preparing the assembly of reinforcing diaphragm 64. In this case, first reinforcing material layer 63A is adhered to a front surface side of reinforcing diaphragm 64. It is preferable to wire relay line 57 in through hole 58 in the step of preparing the assembly of reinforcing diaphragm 64.

The assembly of reinforcing diaphragm 84 shown in FIG. 7 is prepared substantially in the same manner as the assembly of reinforcing diaphragm 64. That is, when thick portion 84A and second insulating portion 84D are formed of parts that are separated from each other, in the step of preparing the assembly of reinforcing diaphragm 84, thick portion 84A and second insulating portion 84D are joined to each other using an adhesive agent or the like. An adhesive agent may be applied, by coating, to a joint area between thick portion 84A and second insulating portion 84D and to groove 85. In this case, relay line 57 shown in FIG. 3 is wired in groove 85 before thick portion 84A and second insulating portion 84D are adhered to each other. With such a configuration, an additional process for adhering relay line 57 and reinforcing diaphragm 84 shown in FIG. 3 to each other becomes unnecessary.

In the step of joining diaphragm 61 shown in FIG. 3 to frame 52, the assembly of planar diaphragm 62 and the assembly of reinforcing diaphragm 64 are adhered to frame 52. That is, an outer peripheral portion of first edge connecting portion 53A is joined to first mounting surface 52D. Further, an outer peripheral portion of second edge connecting portion 53B is joined to second mounting surface 52E. With such a configuration, it is possible to produce diaphragm 61 where first reinforcing material layer 63A is sandwiched between planar diaphragm 62 and reinforcing diaphragm 64. Further, the assembly of planar diaphragm 62 and reinforcing diaphragm 64 are adhered to each other.

As shown in FIG. 5, diaphragm 61 is configured such that planar diaphragm 62 and reinforcing diaphragm 64 are formed as parts that are separated from each other. As shown in FIG. 7, diaphragm 81 is configured such that planar diaphragm 62 and reinforcing diaphragm 84 are formed as parts that are separated from each other. Accordingly, as shown in FIG. 3, the assembly of planar diaphragm 62 can be mounted on frame 52 from a front surface side of frame 52. On the other hand, the assembly of reinforcing diaphragm 64 or the assembly of reinforcing diaphragm 84 can be mounted on frame 52 from a rear surface side of frame 52. Further, the adhesion of the assembly of planar diaphragm 62 and frame 52 to each other and the adhesion of the assembly of planar diaphragm 62 and reinforcing diaphragm 64 or reinforcing diaphragm 84 to each other can be also performed simultaneously. In this step, the assembly of reinforcing diaphragm 64 or the assembly of reinforcing diaphragm 84 and frame 52 may be also simultaneously adhered to each other. Accordingly, it is possible to reduce the number of man-hours for joining diaphragm 61 to frame 52.

It is preferable to mount the assembly of planar diaphragm 62 on frame 52 after the assembly of reinforcing diaphragm 64 is mounted on frame 52. In this case, the front surface of frame 52 is opened in a state before the assembly of planar diaphragm 62 is mounted on frame 52 and hence, relay line 57 and terminal 56 can be easily connected to each other.

It is preferable that voice coil body 55 is joined to diaphragm 61 in the step of joining diaphragm 61 to frame 52. In this case, in a state before the assembly of planar diaphragm 62 is mounted on frame 52, voice coil body 55 is disposed at a predetermined position. With such a configuration, relay line 57 and voice coil 55A can be easily connected to each other. After relay line 57 and voice coil 55A are connected to each other, voice coil body 55 and the assembly of planar diaphragm 62 are adhered to each other. In this case, at the time of bonding voice coil body 55 and the assembly of planar diaphragm 62 to each other, the outer peripheral portion of first edge connecting portion 53A and first mounting surface 52D can be also adhered to each other simultaneously.

After the step of joining diaphragm 61 to frame 52, the assembly of magnetic circuit 54 is joined to frame 52 so that loudspeaker 51 is completed.

As described above, planar diaphragm 62 and reinforcing diaphragm 64 are prepared as parts that are separated from each other, and diaphragm 61 is formed by bonding the planar diaphragm 62 and reinforcing diaphragm 64 to each other. Alternatively, planar diaphragm 62 and reinforcing diaphragm 84 are prepared as parts that are separated from each other and diaphragm 81 is formed by bonding the planar diaphragm 62 and reinforcing diaphragm 84 to each other. Accordingly, even when terminal 56 is disposed inside of gap 52B formed by first edge connecting portion 53A, second edge connecting portion 53B, the inner side surface of frame 52, and the outer peripheral side surface of diaphragm 61, terminal 56 and voice coil 55A can be easily connected to each other.

Although the assembly of planar diaphragm 62 is mounted on frame 52 after the assembly of reinforcing diaphragm 64 is mounted on frame 52, the order of mounting is not limited to such an order. The assembly of planar diaphragm 62 may be mounted on frame 52 before the assembly of reinforcing diaphragm 64 is mounted on frame 52.

Further, voice coil body 55 may be joined to planar diaphragm 62 at the time of preparing the assembly of planar diaphragm 62. In this case, it is preferable that the assembly of planar diaphragm 62 is mounted on frame 52 before the assembly of reinforcing diaphragm 84 is mounted on frame 52. Further, in this case, it is preferable that second insulating portion 84D shown in FIG. 7 is adhered to the assembly of planar diaphragm 62 at the time of preparing the assembly of planar diaphragm 62. With such a configuration, even when terminal 56 is disposed inside of gap 52B formed by first edge connecting portion 53A, second edge connecting portion 53B, the inner side surface of frame 52, and the outer peripheral side surface of diaphragm 61, terminal 56 and voice coil 55A can be easily connected to each other.

Figure 8:
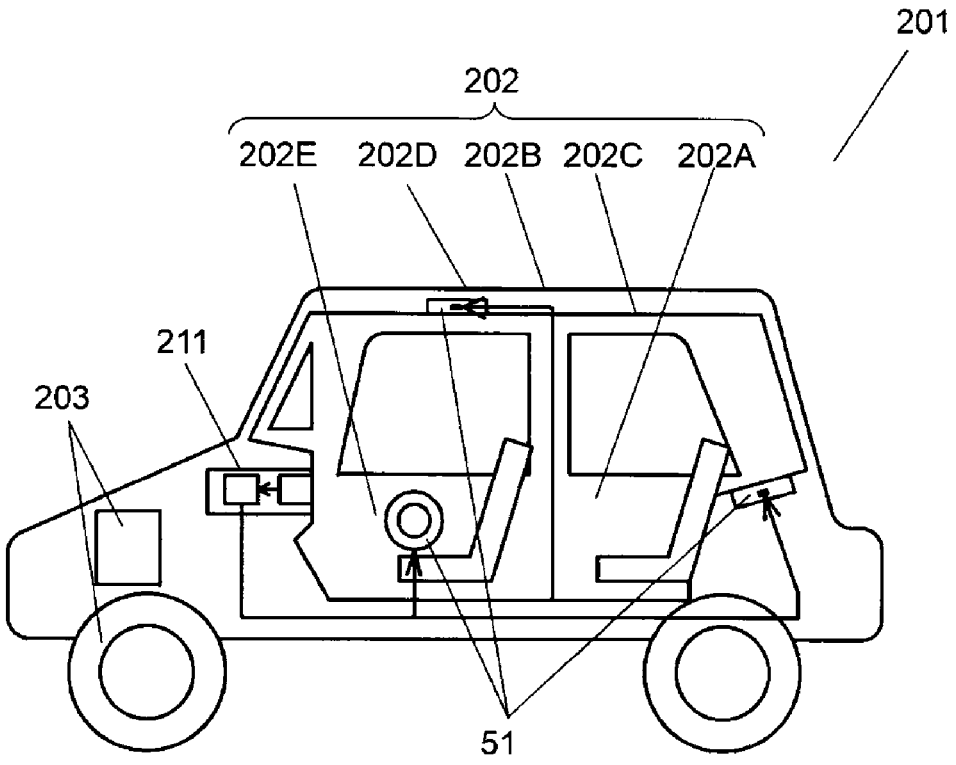
FIG. 8 is a conceptual view of a mobile body device according to the exemplary embodiment.

FIG. 8 is a conceptual view of mobile body device 201 which mounts loudspeaker 51 according to the exemplary embodiment of the present invention thereon. Mobile body device 201 is an automobile, for example. However, mobile body device 201 is not limited to an automobile, and may be a ship, an airplane, a train, a motorcycle, or the like.

Mobile body device 201 includes body unit 202, drive unit 203, amplifying unit 211, and loudspeaker 51. Drive unit 203, amplifying unit 211 and loudspeaker 51 are mounted on body unit 202. Drive unit 203 may include an engine, a motor, a tire, a handle and the like. An output of amplifying unit 211 is supplied to loudspeaker 51. Amplifying unit 211 may configure a part of a car audio. In this case, amplifying unit 211 may include a sound source reproducing device or the like. Further, amplifying unit 211 may configure a part of a car navigation. In this case, amplifying unit 211 may include a display device or the like.

When body unit 202 includes a cabin space 202A, loudspeaker 51 is installed such that loudspeaker 51 can emit a sound toward cabin space 202A. In this case, body unit 202 may further include exterior unit 202B and interior unit 202C. Exterior unit 202B partitions cabin space 202A from the outside. Exterior unit 202B is a roof 202D or a door 202E, for example. Interior unit 202C is disposed between exterior unit 202B and cabin space 202A. Loudspeaker 51 is housed between interior unit 202C and exterior unit 202B. The place where loudspeaker 51 is installed is not limited to the above-mentioned place, and loudspeaker 51 may be installed in a dashboard or a rear tray.

With such a configuration, loudspeaker 51 can be made thin and hence, a distance between interior unit 202C and exterior unit 202B can be decreased. In this manner, when the loudspeaker 51 is mounted on mobile body device 201, cabin space 202A can be enlarged.

The exemplary embodiment described above is provided for facilitating the understanding of the present invention. Materials and shapes of the respective constitutional elements for forming loudspeaker 51 described in the exemplary embodiment can be modified variously, and should not be construed as limiting the scope of the present invention.

Further, the present invention can be modified and improved without departing from the scope of the present invention, and the present invention also includes equivalents of the present invention.

The loudspeaker according to the present invention can acquire an advantageous effect of making the thickness of the loudspeaker thin, and is particularly useful to vehicle-mounted acoustic equipment, acoustic equipment for household use or the like.

The invention claimed is:

1. A loudspeaker, comprising:

a frame having an outer side surface and an inner side surface;

a diaphragm including: a planer diaphragm having a front surface that is flat and a rear surface that is flat and is disposed at a side opposite to the front surface; and a reinforcing diaphragm made of resin, connected to the planer diaphragm, and having a thick portion formed on an outer periphery of the reinforcing diaphragm and a recessed portion formed at a center side with respect to the thick portion, the diaphragm being disposed inside of the frame;

an edge connecting portion for connecting an outer peripheral end portion of the diaphragm and the frame to each other;

a magnetic circuit having a magnetic gap, disposed at a position that opposedly faces the recessed portion, the magnetic circuit being fixed to the frame;

a voice coil body having a first end portion and a second end portion, the first end portion being disposed inside of the magnetic gap, and the second end portion being joined to a center portion of the diaphragm;

a terminal fixed to the frame; and a relay line which electrically connects the terminal and the voice coil to each other, wherein the relay line penetrates at least the thick portion of the diaphragm.

2. The loudspeaker according to claim 1, wherein the relay line extends toward the terminal from a side surface of an outer peripheral portion of the diaphragm in a gap formed between the side surface of the outer peripheral portion of the diaphragm and the inner side surface of the frame.

3. The loudspeaker according to claim 2, wherein the terminal is disposed in the gap and is connected to the relay line in the gap.

4. A mobile body device, comprising:

a body;

a driver and an amplifier which are mounted on the body; and the loudspeaker according to claim 1, wherein an output from the amplifier is supplied to the loudspeaker.

5. The mobile body device according to claim 4, wherein:

the body includes: a space formed in the body; an exterior surface disposed between the space and an outside; and an interior surface disposed between the exterior surface and the space, and the loudspeaker is accommodated between the interior surface and the exterior surface.

6. The mobile body device according to claim 5, wherein the exterior surface is a door or a roof.

7. A loudspeaker, comprising:

a frame having an outer side surface and an inner side surface;

a diaphragm including: a planer diaphragm having a front surface that is flat and a rear surface that is flat and is disposed at a side opposite to the front surface; and a reinforcing diaphragm made of resin, connected to the planer diaphragm, and having a thick portion formed on an outer periphery of the reinforcing diaphragm and a recessed portion formed at a center side with respect to the thick portion, the diaphragm being disposed inside of the frame;

an edge connecting portion for connecting an outer peripheral end portion of the diaphragm and the frame to each other;

a magnetic circuit having a magnetic gap, disposed at a position that opposedly faces the recessed portion, the magnetic circuit being fixed to the frame;

a voice coil body having a first end portion and a second end portion, the first end portion being disposed inside of the magnetic gap, and the second end portion being joined to a center portion of the diaphragm;

a terminal fixed to the frame; and a relay line which electrically connects the terminal and the voice coil to each other, wherein:

the planer diaphragm has a reinforcing material layer made of metal, the reinforcing material layer being disposed on the rear surface of the planer diaphragm, and the reinforcing diaphragm has an insulating portion formed at a bottom of the recessed portion, the insulating portion being disposed between the reinforcing material layer and the relay line.

8. A loudspeaker, comprising:

a frame having an outer side surface and an inner side surface;

a diaphragm including: a planer diaphragm having a front surface that is flat and a rear surface that is flat and is disposed at a side opposite to the front surface; and a reinforcing diaphragm made of resin, connected to the planer diaphragm, and having a thick portion formed on an outer periphery of the reinforcing diaphragm and a recessed portion formed at a center side with respect to the thick portion, the diaphragm being disposed inside of the frame;

an edge connecting portion for connecting an outer peripheral end portion of the diaphragm and the frame to each other;

a magnetic circuit having a magnetic gap, disposed at a position that opposedly faces the recessed portion, the magnetic circuit being fixed to the frame;

a voice coil body having a first end portion and a second end portion, the first end portion being disposed inside of the magnetic gap, and the second end portion being joined to a center portion of the diaphragm;

a terminal fixed to the frame; and a relay line which electrically connects the terminal and the voice coil to each other, wherein:

the planer diaphragm has a reinforcing material layer made of metal, the reinforcing material layer being disposed on the rear surface of the planer diaphragm, and the reinforcing diaphragm has an insulating portion formed outside the recessed portion, the insulating portion being disposed between the reinforcing material layer and the relay line.

* * * * *